United States Patent [19]

Lawrence

[11] 4,048,756

[45] Sept. 20, 1977

[54] AIR RELIEF MECHANISM

[75] Inventor: James R. Lawrence, Brazil, Ind.

[73] Assignee: Raymond Lee Organization, Inc., a part interest

[21] Appl. No.: 706,112

[22] Filed: July 16, 1976

[51] Int. Cl.[2] ..... E06B 7/28

[52] U.S. Cl. ..... 49/171; 98/87

[58] Field of Search ..... 98/87, 88 S, 99.3, 119, 98/114, 13, 18, 37; 55/484, 502, 385 R, 496; 49/171; 52/202; 137/550, 527.8

[56] References Cited

U.S. PATENT DOCUMENTS

| | | | |
|---|---|---|---|
| 1,186,566 | 6/1916 | Fogg | 49/171 |
| 1,648,322 | 11/1927 | Olson et al. | 98/119 |
| 2,211,367 | 8/1940 | Davey et al. | 98/13 |
| 2,506,978 | 5/1950 | Unterberger | 98/87 |
| 2,774,116 | 12/1956 | Wolverton | 98/87 |
| 2,798,422 | 7/1957 | Bourque | 98/87 |
| 2,820,475 | 1/1958 | Hobbs | 98/87 |
| 2,871,523 | 2/1953 | Negoro | 98/87 |

*Primary Examiner*—William E. Wayner
*Assistant Examiner*—Robert Charvat

[57] ABSTRACT

An air relief mechanism for use in an opening in a storm door disposed in hinged relationship in the outer side of a casing around a door opening containing an inner door disposed in hinged relationship within the casing. An inner frame is secured to the inside surface of the storm door and engages the periphery of said opening. A screen is disposed in said frame and fills said opening. An outer frame is secured to the outside surface of the storm door and engages said opening, said frame having a slot disposed outside the storm door. A flap is pivotally disposed in said outer frame, said flap being biased into a normal first position at which said opening and said slot are isolated from each other, said flap responding to an air pressure differential developed when one of said doors is moved from open to closed position while the other door is in the closed position to momentarily assume a second position at which said opening and said slot communicate with each other and said differential is quickly reduced to zero.

3 Claims, 3 Drawing Figures

FIG. 1
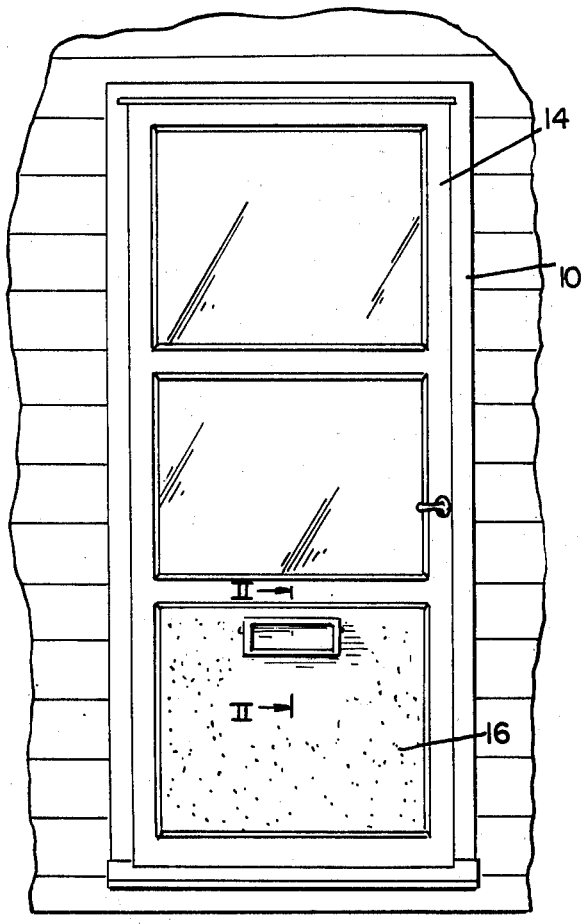
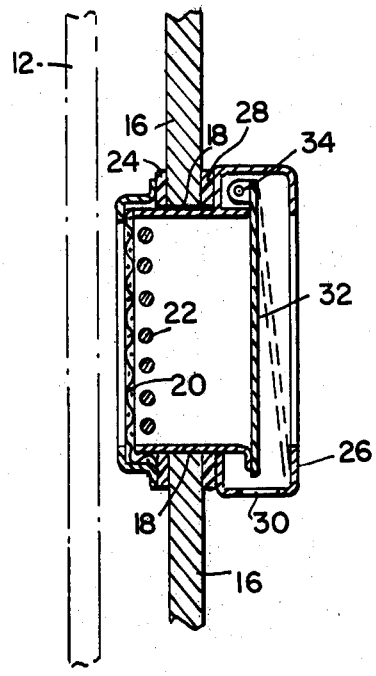
FIG. 2
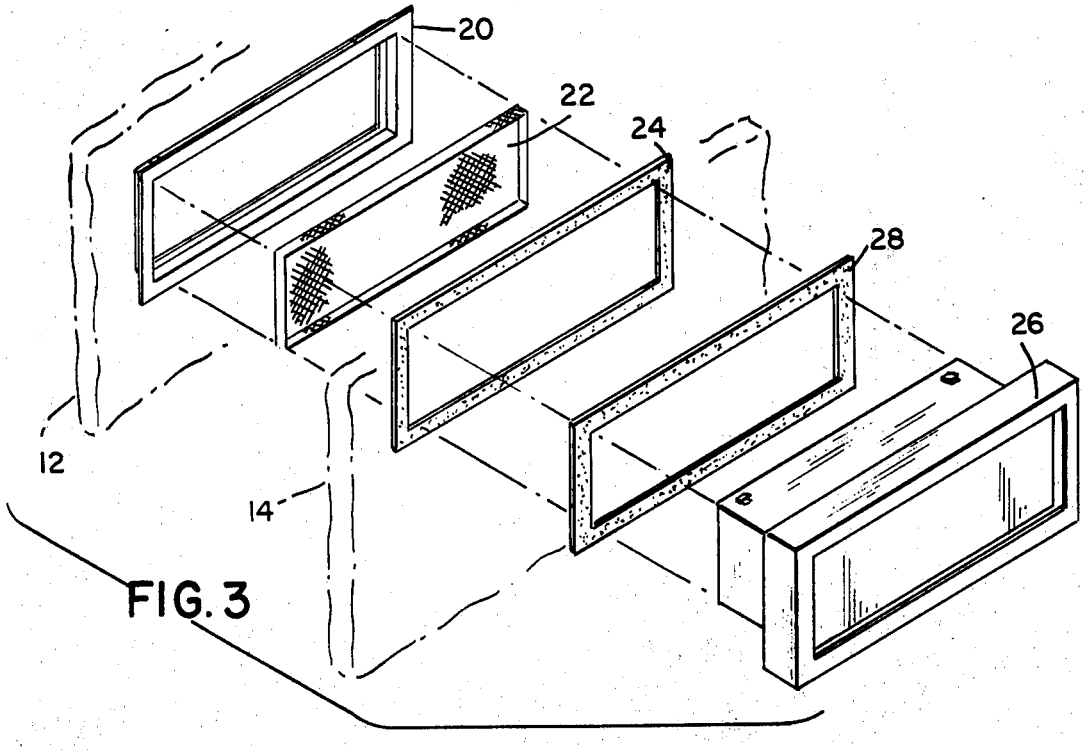
FIG. 3

AIR RELIEF MECHANISM

BACKGROUND OF THE INVENTION

Many homes as well as other types of buildings utilize outer storm doors in addition to the inner doors. It is well known that when both doors fit tightly, differential air pressures created when one door is closed and the other door is moved from open to closed position make closure difficult. Various types of air relief devices, as for example those shown in U.S. Pat. No. 2,798,422 can be installed into the storm door to eliminate these differentials quickly and thus ease the closure.

The present invention is directed toward a new type of air relief mechanism which can be manufactured and installed at lesser cost and with greater speed than heretofore obtainable and which is durable and long lasting in use.

SUMMARY OF THE INVENTION

In accordance with the principles of the invention, there is provided an air relief mechanism for use in an opening in a storm door disposed in hinged relationship in the outer side of a casing around a door opening containing an inner door disposed in hinged relationship within the casing. The mechanism employs an inner frame secured to the outside surface of the storm door and engaging said opening, said frame having a slot disposed outside the storm door. A flap pivotally disposed in said outer frame, said flap being biased into a normal first position at which said opening and said slot are isolated from each other. The flap responds to an air pressure differential developed when one of said doors is moved from open to closed position while the other door is in the closed position to momentarily assume a second position at which said opening and said slot communicate with each other and said differential is quickly reduced to zero.

This quick essentially instantaneous reduction makes opening and closing of doors much easier.

BRIEF DESCRIPTION OF THE DRAWINGS

FIG. 1 is a front view showing the invention in use.
FIG. 2 is a view taken along line 2—2 in FIG. 1.
FIG. 3 is an exploded view of the invention.

DETAILED DESCRIPTION OF PREFERRED EMBODIMENT

Referring now to FIGS. 1-3, a casing 10 contains an inner door 12 disposed in hinged relationship within the casing and an outer storm door 14 disposed in hinged relationship in the outer side of the casing. The door 14 has a bottom solid opaque section 16 with a horizontally elongated rectangular slot 18 therein.

An open inner rectangular frame 20 with a mesh or screen 22 in its central opening is disposed on the inner surface of the door 14 and is sealed into the opening by means of a first gasket 24. An outer open rectangular frame 26 is disposed on the outer surface of the door 14 and extends through the slot, frame 26 being sealed into the opening by means of a second gasket 28. Frame 26 has a bottom disposed slot 30.

Frame 26 also has a flap 32 pivotably disposed therein and normally biased into vertical closed position by spring 34. This position isolates the opening 18 from slot 30 whereby air flow therebetween cannot take place. However, when one of the doors is moved from open to closed position while the other door is in the closed position, a differential air pressure is established which overcomes the spring bias and opens the flap (as shown in phantom in FIG. 2). At this point, air flows through the opening and slot into the outside, reducing the differential to zero very rapidly. The door can then be closed easily. The absence of the differential permits the spring bias to be restored whereby the flap is automatically closed.

While the invention has been described with particular reference to the drawings, the protection sought is to be limited only by the terms of the claims which follow.

I claim:

1. An air relief mechanism for use in an opening in a storm door disposed in hinged relationship in the outer side of a casing around a door opening containing an inner door disposed in hinged relationship within the casing, said mechanism comprising:
   - an open inner rectangular frame disposed on the inside surface of the storm door and sealed into the periphery of said opening;
   - a screen disposed in said inner frame and filling the opening therein;
   - an open outer rectangular frame disposed on outside surface of the storm door and sealed into said opening, said outer frame having a slot disposed outside the storm door; and
   - a flap pivotally disposed in said outer frame between the inner frame and said slot, said flap being biased into a normal first vertical position at which said opening and said slot are isolated from each other, said flap responding to an air pressure differential developed when one of said doors is moved from open to closed position while the other door is in the closed position to momentarily assume a second inclined position at which said opening and said slot communicate with each other and said differential is quickly reduced to zero.

2. The mechanism of claim 1 further including separate gasket sealing means for each of said frames to separately seal each frame into said opening.

3. The mechanism of claim 2 further including means spring biasing the flap into first position.

* * * * *